US006524140B2

(12) United States Patent
Takagi et al.

(10) Patent No.: US 6,524,140 B2
(45) Date of Patent: Feb. 25, 2003

(54) CONNECTOR EXCELLENT IN RELIABILITY OF CONTACT

(75) Inventors: Osamu Takagi, Oume; Kazumi Takishima, Tachikawa; Yoshifumi Kubota, Tokyo; Yasufumi Hayashi, Tachikawa, all of (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 0 days.

(21) Appl. No.: 09/880,608

(22) Filed: Jun. 13, 2001

(65) Prior Publication Data

US 2001/0055903 A1 Dec. 27, 2001

(30) Foreign Application Priority Data

Jun. 21, 2000 (JP) ..... 2000-186830

(51) Int. Cl.[7] ..... H01R 13/24
(52) U.S. Cl. ..... 439/700
(58) Field of Search ..... 439/700, 824, 439/482, 884, 805, 819, 728, 820, 801, 217, 289, 320, 188, 387; 200/51.1; 174/51

(56) References Cited

U.S. PATENT DOCUMENTS 2,265,998 A * 12/1941 Bruno ..... 200/51.1
5,304,753 A * 4/1994 Parrish et al. ..... 200/16 B
5,713,765 A * 2/1998 Nugent ..... 439/700

FOREIGN PATENT DOCUMENTS

| | | | |
|---|---|---|---|
| EP | 0899832 A | 3/1999 | ..... H01R/23/72 |
| EP | 0945937 A | 9/1999 | ..... H01R/43/16 |
| JP | 11-3626 | 2/2000 | ..... H01R/13/08 |

* cited by examiner

*Primary Examiner*—Neil Abrams
*Assistant Examiner*—J. F. Duverne
(74) *Attorney, Agent, or Firm*—Michael Best & Friedrich LLC

(57) ABSTRACT

In a connector in which a conductive contacting portion (33) is supported by a spring portion (26) to be elastically movable in a first direction (28) and a second direction (29) perpendicular to the first direction, the contacting portion has a contact point (27) maintained in a specific condition such that the contact point is offset from a predetermined position in the second direction. The contact point is formed at its one end to be brought into contact with a mating object (17) in the first direction at the predetermined position. When the contacting portion is moved in a direction opposite to the first direction, the specific condition is released.

6 Claims, 3 Drawing Sheets

CONNECTOR EXCELLENT IN RELIABILITY OF CONTACT

BACKGROUND OF THE INVENTION

This invention relates to a connector having a contacting portion to be brought into butt contact with a mating object and, in particular, to a connector having a contact cleaning function achieved by sliding a contacting portion with respect to a mating object during connecting and disconnecting operations.

For example, a conventional connector of the type is disclosed in Japanese patent No. 3035776. The conventional connector includes a plug housing comprising an insulator and a conductive plug contact held by the plug housing. The plug contact has a conductive protruding contacting portion to be brought into contact with a mating object in a first direction, and a spring portion elastically supporting the protruding contacting portion in the first direction and in a second direction perpendicular to the first direction.

On the other hand, the mating object includes a conductive receptacle contact having a V-shaped contacting portion and a receptacle housing comprising an insulator and holding the receptacle contact.

The plug housing and the receptacle housing have shapes and dimensions such that these housings can be fitted or coupled to each other. The protruding contacting portion and the V-shaped contacting portion have a positional relationship such that these contacting portions are faced to each other in the first direction to be slightly eccentric or offset from each other at the start of coupling of the plug housing and the receptacle housing. With the progress of the coupling, the protruding contacting portion is brought into contact with a slant surface of the V-shaped contacting portion and then slides along the slant surface towards a bottom of the V-shaped contacting portion. When the contacting portion reaches the bottom of the V-shaped contacting portion, the spring portion has an unbalanced displacement. During the sliding movement, contact points between the plug contact and the receptacle contact are cleaned. Thus, a contact cleaning function is achieved.

However, since the protruding contacting portion moves in the second direction during the sliding movement along the slant surface of the V-shaped contacting portion, the spring portion may interfere with the insulator with having the unbalanced displacement thereof. Depending upon the magnitude of the displacement of the spring portion, expected contacting force can not be obtained and a predetermined operation of the plug contact may be inhibited. Furthermore, since the mating object has the V-shaped contacting portion, dust may be trapped and deposited at the bottom thereof to cause insufficient or defective contact. In addition, while the connector is connected to the mating object, the spring portion keeps the unbalanced displacement. Therefore, the reliability of contact is low.

SUMMARY OF THE INVENTION

It is therefore an object of this invention to provide a connector excellent in reliability of contact.

It is another object of this invention to provide a connector capable of achieving a contact cleaning function with a structure such that a spring portion does not have an unbalanced displacement when the connector is connected to a mating object.

Other objects of the present invention will become clear as the description proceeds.

According to this invention, there is provided a connector including a conductive contacting portion having a contact point formed at its one end to be brought into contact with a mating object in a first direction at a predetermined position, a spring portion supporting the contacting portion so that the contact point is elastically movable in the first direction and a second direction perpendicular to the first direction, and displacement maintaining means for maintaining the contact point in a specific condition such that the contact point is offset from the predetermined position in the second direction. The displacement maintaining means releases the specific condition when the contacting portion is moved in a direction opposite to the first direction.

DESCRIPTION OF THE PREFERRED EMBODIMENT

Figure 1:
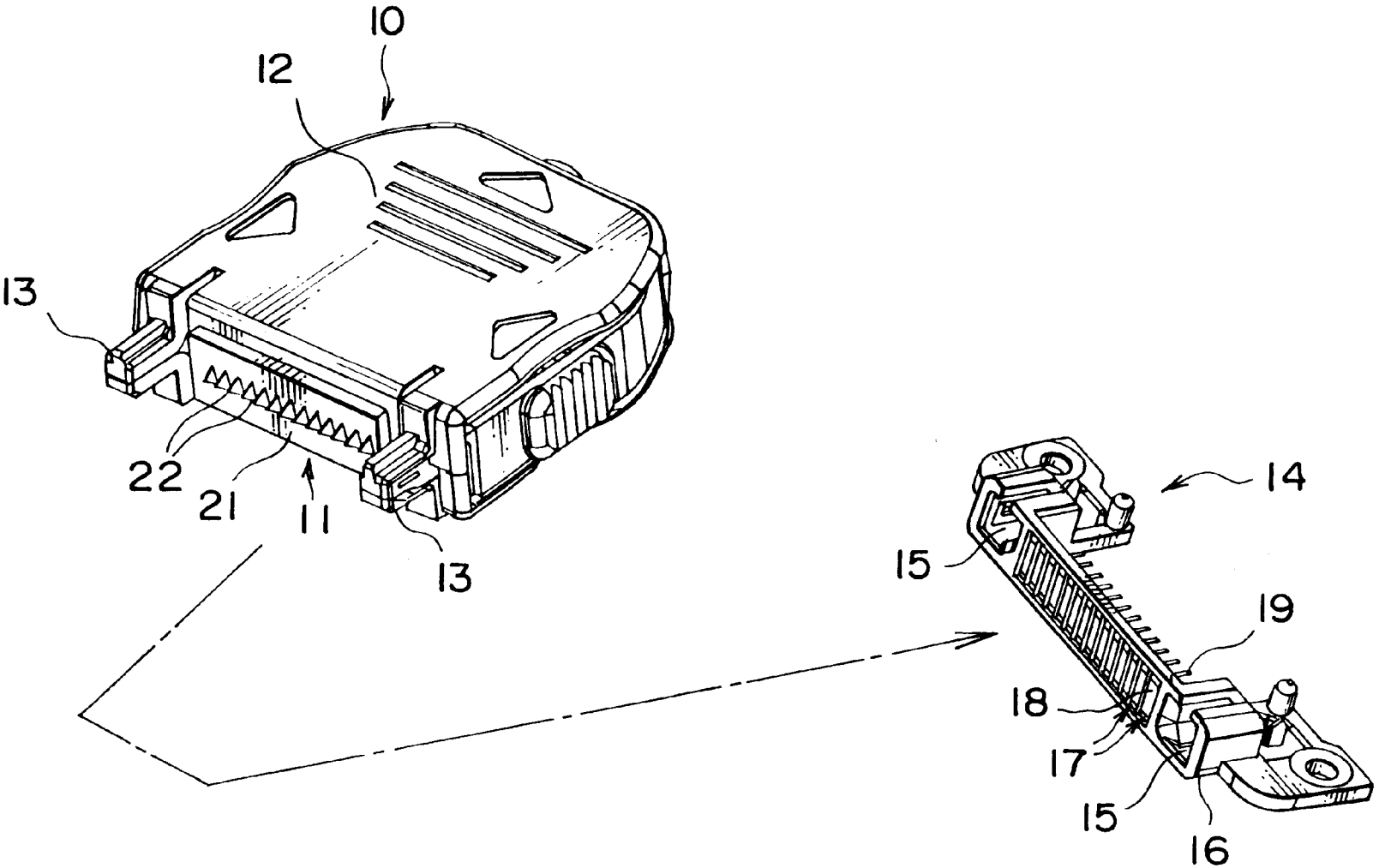
FIG. 1 is a perspective view of a connector according to one embodiment of this invention together with a mating object.

Referring to FIG. 1, description will be made of a connector according to one embodiment of this invention together with a mating object.

The connector depicted by a reference numeral 10 in the figure is a so-called plug connector and includes a connector element 11 and a hood 12 covering the most of an outer periphery of the connector element 11 except a front surface thereof. The hood 12 has a pair of guide portions 13 formed on its front surface. The guide portions 13 are adapted to be inserted into a pair of guide holes 15 of a mating object 14, respectively, to guide connection of the connector 10 and the mating object 14.

The mating object 14 is a so-called receptacle connector and includes an insulator 16 provided with the guide holes 15 and a plurality of conductive mating contacts 17 held by the insulator 16. Each of the mating contacts 17 has a contacting portion 18 and a terminal portion 19 connected to the contacting portion 18. The mating object 14 is mounted on a printed circuit board (not shown).

Figure 2:
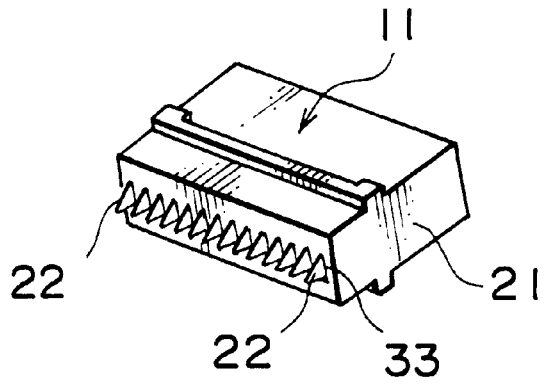
FIG. 2 is a perspective view of a connector element contained in the connector illustrated in FIG. 1.
Figure 3:
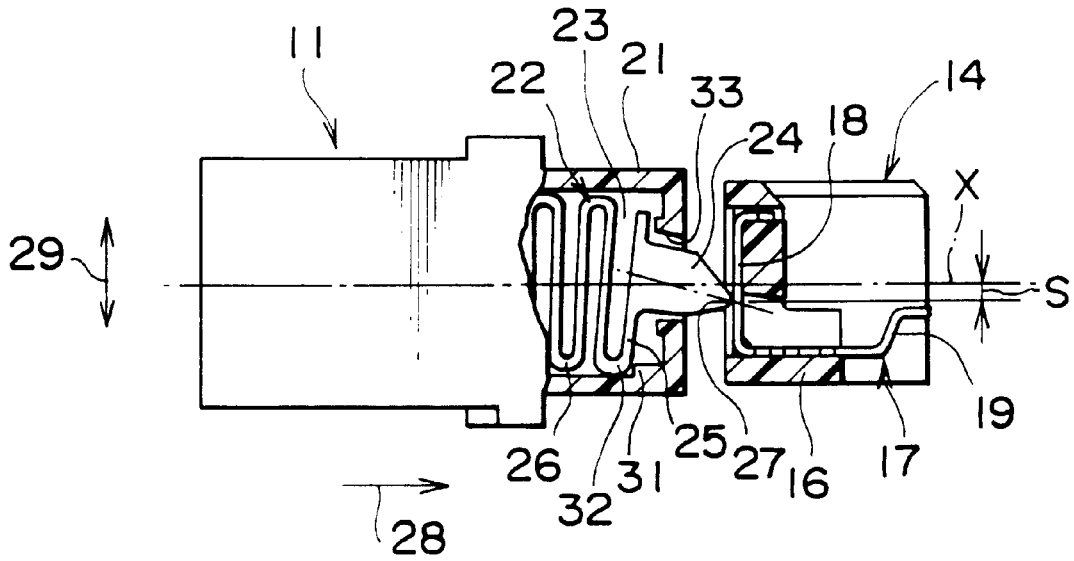
FIG. 3 is a partially-sectional enlarged view of the connector element illustrated in FIG. 2 at the start of connection with the mating object illustrated in FIG. 1.

Referring to FIGS. 2 and 3 in addition to FIG. 1, description will be made of the connector element 11.

The connector element 11 comprises an insulator 21 fixedly held by the hood 12, and a plurality of conductive contacts 22 supported by the insulator 21. The contacts 22 of the connector element 11 are arranged in one-to-one correspondence to the mating contacts 17 of the mating object 14.

The insulator 21 is provided with a receiving portion 23 as a large space for accommodating the contacts 22. Each of the contacts 22 has a contacting portion 24, an arm portion 25, and a spring portion 26 integrally formed. The contacting portion 24 has one end protruding from the receiving portion 23 to the outside of the insulator 21 and the other end located within the receiving portion 23. The arm portion 25 extends within the receiving portion 23 from the other end of the contacting portion 24 towards the insulator 21. The spring portion 26 extends within the receiving portion 23 from an end of the arm portion 25. Each contact 22 is formed from a conductive plate by punching.

The contacting portion 24 has a contact point 27 formed at its one end, i.e., a tapered end. The contact point 27 is adapted to be brought into contact with the contacting portion 18 of the mating contact 17 of the mating object 14 in a first direction 28 at a predetermined position.

The spring portion 26 is formed along an axis X extending at the center of the receiving portion 23 in the first direction 28 and has a serpentine shape starting from one end connected to the arm portion 25. Specifically, the spring portion 26 meanders within a plane extending in the first direction 28 and a second direction 29 perpendicular to the first direction 28 and extends in the first direction 28. Thus, the spring portion 26 is extendible and compressible within the receiving portion 23 and supports the contacting portion 24 so that the contact point 27 is elastically movable in the first and the second directions 28 and 29. Although not illustrated in the figure, the spring portion 26 has the other end connected to a holding portion (not shown) held by the receiving portion 23 and to a terminal portion (not shown) connected to the holding portion.

The insulator 21 has an inner wall surface provided with a locking portion or a stopper portion 31 formed on one side of the spring portion 26 in the second direction 29. The arm portion 25 extends towards the one side of the spring portion 26 in the second direction 29 and has an engaging portion 32 to be engaged with the stopper portion 31. At the start of connection illustrated in FIG. 3, the engaging portion 32 is engaged with the stopper portion 31 with the spring portion 26 applied with a load. Therefore, the contacting portion 24 is inclined to be oriented in a direction intersecting with the axis X at an acute angle. As a result, the contact point 27 is maintained in a specific condition such that the contact point 27 is offset or shifted from the axis X in the second direction 29. The amount of the offset is depicted by S in FIG. 3. In the specific condition, the spring portion 26 has restoring force in the first and the second directions 28 and 29. A combination of the stopper portion 31 and the engaging portion 32 serves as displacement maintaining means.

The insulator 21 is provided with a slit 33 formed in a front wall at one end in the first direction 28 and extending in the second direction 29. The contacting portion 24 is partially exposed at the outside of the insulator 21 through the slit 33 and has the contact point 27 formed at its outer end.

Figure 4:
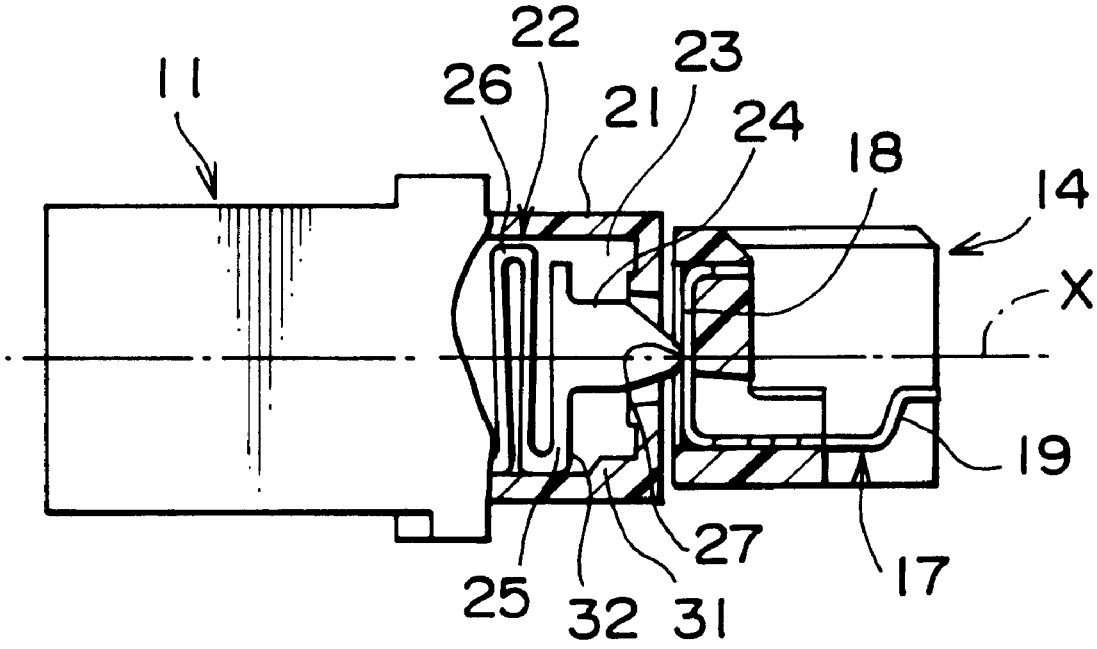
FIG. 4 is a partially-sectional enlarged view of the connector element illustrated in FIG. 2 at the completion of connection with the mating object illustrated in FIG. 1.

Next referring to FIG. 4 in addition to FIGS. 1 and 3, description will be made of the connection between the connector 10 and the mating object 14.

In order to connect the connector 10 to the mating object 14, the front surface of the connector element 11 is faced to a front surface of the mating object 14. Then, approaching force is applied between the connector 10 and the mating object 14 in the first direction 28. In this event, the contacting portion 24 is pushed into the receiving portion 23 and further urges the spring portion 26. When the contacting portion 24 is pushed into the receiving portion 23, the above-mentioned specific condition is released by the restoring force of the spring portion 26 in the second direction 29. As a result, the contacting portion 24 is restored in position to be oriented in another direction coincident with the axis X. During the restoration, the contact point 27 slides on the contacting portion 18 of the mating contact 17 of the mating object 14. Finally, the contact point 27 is located at a predetermined position on the axis X. During the sliding movement of the contact point 27 on the contacting portion 18, the contact point 27 is cleaned.

When the connector 10 is connected to the mating object 14, the guide portions 13 of the hood 12 are fitted into the guide holes 15 of the insulator 16 of the mating object 14. Therefore, the connector element 11 is guided in a proper position with respect to the mating object 14. Accordingly, the spring portion 16 is compressed with a balance maintained.

With the above-mentioned connector 10, since the contact point 27 is cleaned by the restoring force of the spring portion 26, the contact 22 can readily be prevented from interfering with the insulator 21 in a state where the spring portion 26 has an unbalanced displacement. Predetermined contacting force is easily obtained and a predetermined operation of the contact 22 is not inhibited. In addition, the contacting portion 18 of the mating object 14 need not be formed into a special shape so that defective contact hardly occurs. Furthermore, the spring portion 26 does not keep the unbalanced displacement while the connector 10 is connected to the mating object 14. Thus, the above-mentioned connector is improved in reliability of contact without difficulty.

In case where the hood 12 is not used, the guide portions 13 are formed on the insulator in the vicinity of opposite ends thereof.

What is claimed is:

1. A connector comprising:

a conductive contacting portion having a contact point formed at its one end to be brought into contact with a mating object in a first direction at a predetermined position;

a spring portion supporting the contacting portion so that the contacting point is elastically movable in the first direction and a second direction perpendicular to the first direction;

displacement maintaining means for maintaining the contact point in a specific condition such that the contact point is offset from the predetermined position in the second direction;

said displacement maintaining means releasing the specific condition when the contacting portion is moved in a direction opposite to the first direction;

the contacting portion being inclined in a direction intersecting with the first direction at an acute angle when the specific condition is maintained, and the contacting portion being kept in substantially another direction parallel to the first direction under a restoring force of the spring portion acting in the second direction when the specific condition is released.

2. The connector according to claim 1, further comprising an arm portion connected between the contacting portion and the spring portion, the displacement maintaining means having a locking portion for locking the arm portion in the first direction.

3. The connector according to claim 2, further comprising an insulator receiving the spring portion, the locking portion being formed on the insulator.

4. The connector according to claim 1, wherein the spring portion meanders in a plane extending in the first and the second directions and extends in the first direction.

5. The connector according to claim 1, wherein the spring portion is electroconductive and is electrically connected to the contacting portion.

6. The connector according to claim 1, further comprising an insulator defining a receiving portion accommodating the spring portion, the insulator having a slit formed at one end in the first direction to extend in the second direction, the contacting portion having a part inserted into the slit.

* * * * *